US009373440B2

(12) United States Patent
Chou

(10) Patent No.: US 9,373,440 B2
(45) Date of Patent: Jun. 21, 2016

(54) COMPOSITE TRANSFORMER WITH A LONGER CREEPAGE DISTANCE

(71) Applicant: INNOTRANS TECHNOLOGY CO., LTD., Taipei (TW)

(72) Inventor: Tsung-Han Chou, Keelung (TW)

(73) Assignee: INNOTRANS TECHNOLOGY CO., LTD., Taipei (TW)

( * ) Notice: Subject to any disclaimer, the term of this patent is extended or adjusted under 35 U.S.C. 154(b) by 13 days.

(21) Appl. No.: 14/193,292

(22) Filed: Feb. 28, 2014

(65) Prior Publication Data

US 2015/0248965 A1 Sep. 3, 2015

(51) Int. Cl.

| | |
|---|---|
| ***H01F 27/30*** | (2006.01) |
| ***H01F 27/02*** | (2006.01) |
| ***H01F 27/29*** | (2006.01) |
| ***H01F 27/32*** | (2006.01) |
| *H01F 38/08* | (2006.01) |

(52) U.S. Cl.

CPC ..... *H01F 27/325* (2013.01); *H01F 27/324* (2013.01); *H01F 38/08* (2013.01)

(58) Field of Classification Search

CPC ..... H01F 38/12; H01F 5/04; H01F 27/306; H01F 27/325

USPC ..... 336/90, 192, 196, 198

See application file for complete search history.

(56) References Cited

U.S. PATENT DOCUMENTS

| | | | | |
|---|---|---|---|---|
| 4,000,483 | A * | 12/1976 | Cook | H01F 27/325 336/192 |
| 7,446,641 | B2 | 11/2008 | Fushimi | |
| 8,022,803 | B2 * | 9/2011 | Park | H01F 27/325 336/136 |
| 2007/0285203 | A1 * | 12/2007 | Ger | H01F 27/325 336/208 |
| 2013/0076471 | A1 * | 3/2013 | Chan | H01F 27/324 336/192 |

FOREIGN PATENT DOCUMENTS

| | | |
|---|---|---|
| TW | I338310 B | 3/2011 |
| TW | I353613 B | 12/2011 |
| TW | I390558 B | 3/2013 |

* cited by examiner

*Primary Examiner* — Tsz Chan

(74) *Attorney, Agent, or Firm* — Muncy, Geissler, Olds & Lowe, P.C.

(57) ABSTRACT

A composite transformer with a longer creepage distance includes a primary winding rack and an insulation support rack mounted onto the primary winding rack. The insulation support rack includes a first insulation half shell and a second insulation half shell that have respectively a first encasing portion and a second encasing portion to encase the primary winding rack. The first and second encasing portions have respectively a first insulation portion and a second insulation portion, and a first isolating portion and a second isolating portion extended respectively from the first and second insulation portions. The first isolating portion has a first covering section extended towards the second isolating portion to cover the second isolating portion. The second isolating portion has a second covering section extended towards the first isolating portion to cover the first isolating portion.

9 Claims, 5 Drawing Sheets

COMPOSITE TRANSFORMER WITH A LONGER CREEPAGE DISTANCE

FIELD OF THE INVENTION

The present invention relates to a composite transformer and particularly to a composite transformer with an increased creepage distance.

BACKGROUND OF THE INVENTION

In electric equipment, the transformer plays an important role for power conversion or signal isolation. However, a transformer usually generates drastic and notable current and voltage changes during power transmission process. In order to guarantee safety of the transformer during the power transmission process almost all countries have established very strict safety regulations, such as IEC/UL 60950-1:2000 or the like.

Take IEC/UL 60950-1:2000 for instance, it regulates required insulation conditions of the transformer structure for safety implementation, such as creepage distance, clearance and the like. The creepage distance, in an example of two windings, means the shortest distance of electricity passing through the surface of the transformer winding rack while crossing from one winding to another winding. The minimum creepage distance set in the safety regulations has a corresponding distance limitation according to different transformer implementation environments. To comply with the limitation of creepage distance in the safety regulations, the producer has tried to provide a corresponding structure, such as Taiwan patent Nos. I353613, I390558, M421580 and I338310. At present, most producers adopt a common practice of increasing the distance between the primary side and secondary side of the transformer winding rack to extend the creepage distance. But such a practice also increases the size of the transformer winding rack and makes miniaturization impossible. In addition to the aforesaid practice, Taiwan patent No. I338310 provides a first insulation portion protrusive outside significantly to increase the creepage distance of the transformer winding rack. But the protrusive first insulation portion makes the transformer winding rack implementable only on an upright transformer, but cannot be adaptable for horizontal transformer.

SUMMARY OF THE INVENTION

The primary object of the present invention is to overcome the problem of the conventional transformers with bulky size or implementation difficulty resulted from complying with the insulation limitation of safety regulations.

To achieve the foregoing object, the present invention provides a composite transformer with a longer creepage distance. The composite transformer includes a primary winding rack and an insulation support rack. The primary winding rack includes two coaxial winding portions to hold respectively a primary winding and a secondary winding, two wiring portions at two opposite sides of the two winding portions, a separated portion with two spacers spaced from each other to form a spaced section and separate the two winding portions, and an installation channel to hold an iron core set which runs through the two winding portions and forms magnetic coupling with magnetic paths generated by the primary winding and the secondary winding upon being energized by electricity. The insulation support rack is installed on the primary winding rack and includes a first insulation half shell and a second insulation half shell that are corresponding to each other and coupled to encase at least one of the two winding portions. The first insulation half shell and second insulation half shell include respectively a first encasing portion and a second encasing portion to encase two sides of the winding portion. The first and second encasing portions have respectively a first insulation portion and a second insulation portion corresponding to the separated portion and extending into the spaced section, and a first isolating portion and a second isolating portion extended from the first insulation portion and the second insulation portion respectively to cover another two sides of the winding portion. The first isolating portion has a first covering section extended towards the second isolating portion to cover the second isolating portion. The second isolating portion has a second covering section extended towards the first isolating portion to cover the first isolating portion.

In one embodiment the first insulation portion has a first indented section covered by the second covering section and forming a step difference with the surface of the first insulation portion, and the second insulation portion has a second indented section covered by the first covering section and forming another step difference with the surface of the second insulation portion In another embodiment each wiring portion includes a first retaining portion located at the opening of one end of the installation channel and two coupling portions at two sides of the first retaining portion. The first insulation half shell and second insulation half shell have respectively a first abutting portion and a second abutting portion held on the two coupling portions, and a first positioning portion and a second positioning portion connected to the first and second abutting portions to butt the first retaining portion.

In yet another embodiment the primary winding rack has a second retaining portion located above the first retaining portion and corresponding thereto. The first insulation half shell and second insulation half shell have respectively a first auxiliary positioning portion and a second auxiliary positioning portion that are corresponding to each other and butt the second retaining portion.

In yet another embodiment the composite transformer further includes a leakage inductance adjustment member mounted on the insulation support rack and a magnetic element embedded in the leakage inductance adjustment member. The first insulation half shell has a first installation portion extended from the first auxiliary positioning portion to locate above the first abutting portion, the second insulation half shell has a second installation portion extended from the second auxiliary positioning portion to locate above the second abutting portion, and the leakage inductance adjustment member has two tracks to couple respectively with the first installation portion and second installation portion.

In yet another embodiment the iron core set is selected from the group consisting of EE, EI, FI, FF, TU, UU and UI types.

In yet another embodiment the composite transformer further includes an auxiliary insulation portion corresponding to the first and second isolating portions.

In yet another embodiment the two spacers have different extended heights.

In yet another embodiment the first insulation half shell and second insulation half shell are mating each other.

The invention, through the structure set forth above, compared with the conventional transformer winding rack structures, provides features as follows:

Through the first and second covering sections, the first and second insulation half shells form a longer creepage distance after coupling together to comply with the safety regulations without changing the transformer structure.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
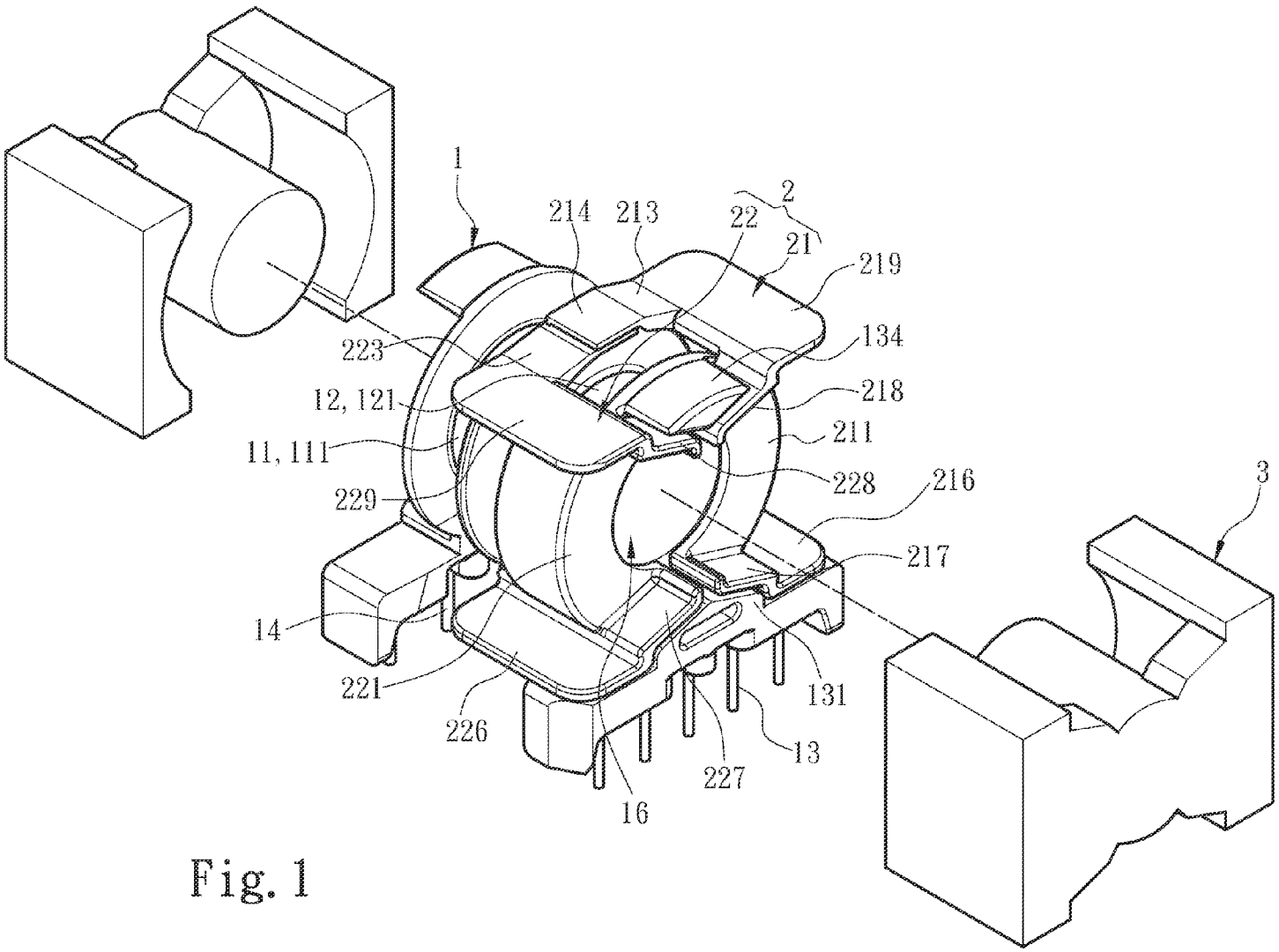
FIG. 1 is an exploded view of a first embodiment of the composite transformer with a longer creepage distance according to the invention.
Figure 2:
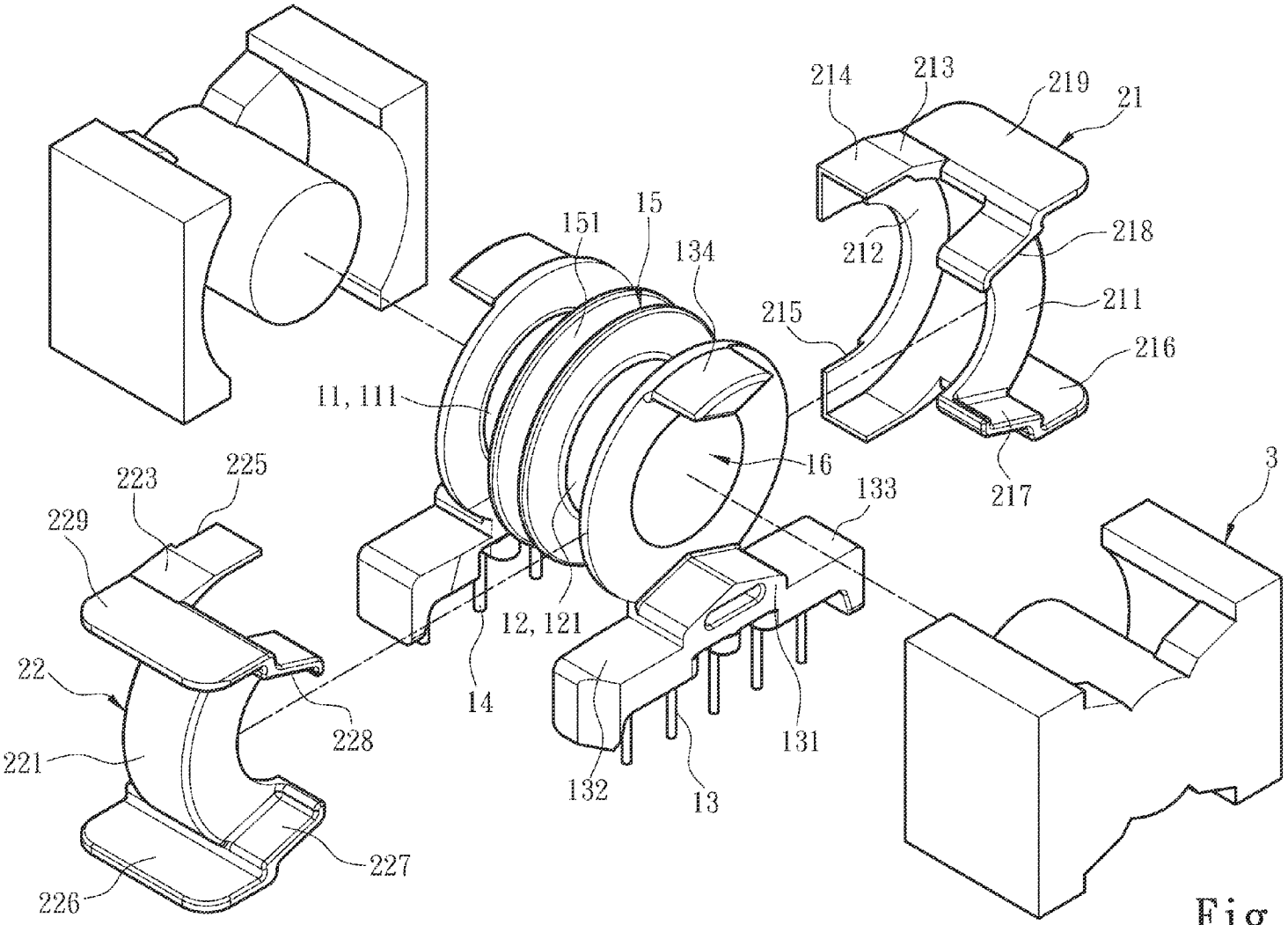
FIG. 2 is another exploded view of the first embodiment of the composite transformer according to the invention.

Please refer to FIGS. 1 through 4, the present invention aims to provide a composite transformer with a longer creepage distance that is a horizontal transformer. The composite transformer mainly includes a primary winding rack 1 and an insulation support rack 2. The primary winding rack 1 includes two coaxial winding portions 11 and 12 to be wound respectively by a primary winding 111 and a secondary winding 121, two wiring portions 13 and 14 at two opposite sides of the two winding portions 11 and 12, a separated portion 15 located between the two winding portions 11 and 12, and an installation channel 16 running through the two winding portions 11 and 12. The separated portion 15 has two spacers 151 spaced from each other to form a spaced section G and separate the two winding portions 11 and 12. The spaced section G is adjustable according to the electric environment where the transformer is to be installed. In this embodiment the two spacers 151 are extended to a same height, but this is not the limitation, different heights also are allowed. The installation channel 16 can hold an iron core set 3 which forms magnetic coupling with magnetic paths generated by the primary winding 111 and the secondary winding 121 when being energized by electricity. The iron core set 3 can be selected from the group consisting of EE, EI, FI, FF, TU, UU and UI types.

Figure 3:
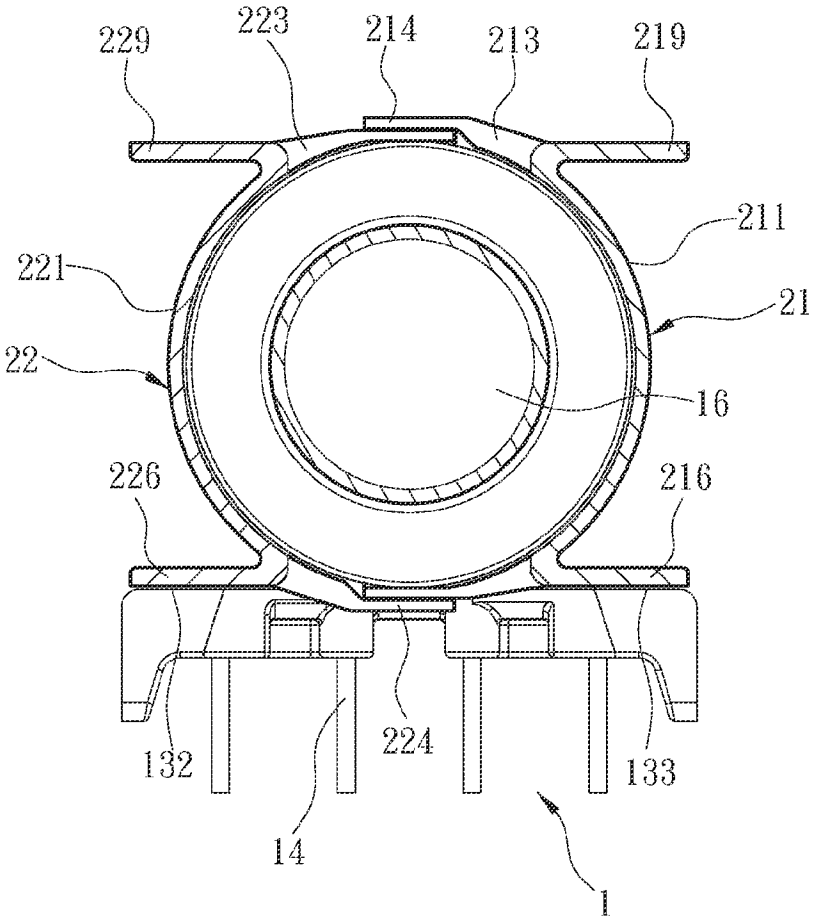
FIG. 3 is a cross section of the first embodiment of the composite transformer according to the invention.
Figure 4:
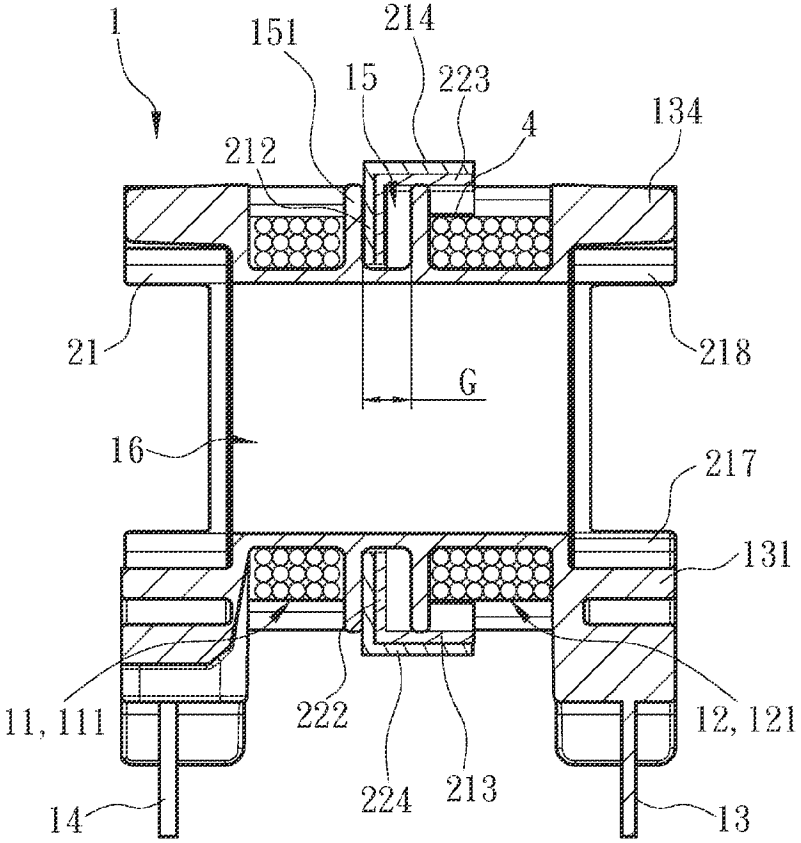
FIG. 4 is another cross section of the first embodiment of the composite transformer according to the invention.
Figure 5:
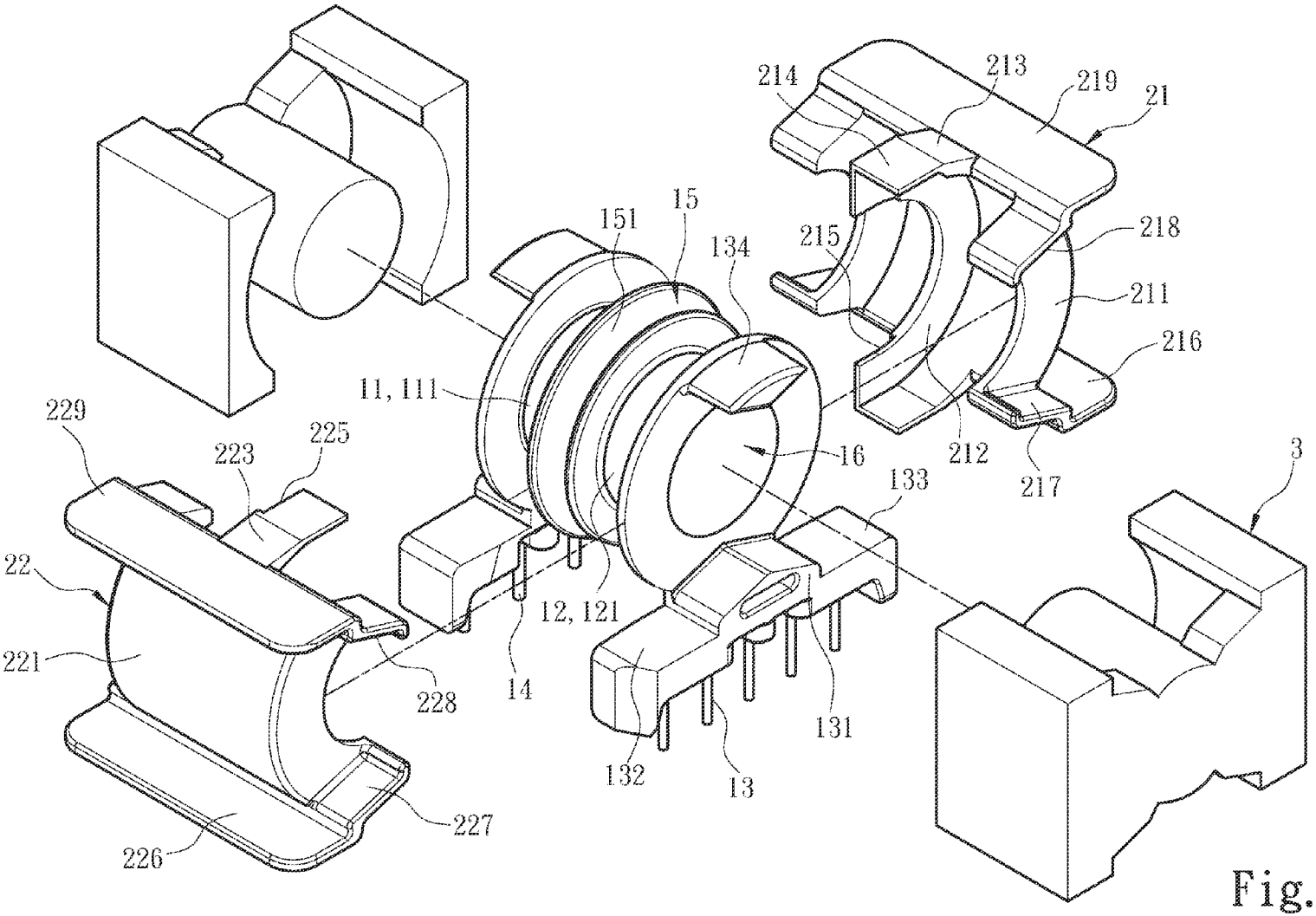
FIG. 5 is an exploded view of a second embodiment of the composite transformer according to the invention.

The insulation support rack 2 is installed on the primary winding rack 1 and includes a first insulation half shell 21 and a second insulation half shell 22 that are corresponding to each other and coupled to encase at least one of the two winding portions such as the winding portion 12. The first insulation half shell 21 and second insulation half shell 22 also can be mating each other, and include respectively a first encasing portion 211 and a second encasing portion 221 to encase two sides of the winding portion 12. The first and second encasing portions 211 and 221 have respectively a first insulation portion 212 and a second insulation portion 222 corresponding to the separated portion 15 and extending into the spaced section G, and a first isolating portion 213 and a second isolating portion 223 extended from the first insulation portion 212 and the second insulation portion 222 to cover another two sides of the winding portion 12. Furthermore, the first isolating portion 213 has a first covering section 214 extended towards the second isolating portion 223 to cover the second isolating portion 223. The second isolating portion 223 has a second cover section 224 extended towards the first isolating portion 213 to cover the first isolating portion 213. The first insulation half shell 21 and second insulation half shell 22 are shown in FIGS. 3 and 4 after installation is finished. The overlapped portions of the first and second covering sections 214 and 224 of the first insulation half shell 21 and second insulation half shell 22 is the increased creepage distance portion of the invention. Through the overlapped structure, the creepage distance of the composite transformer of the invention is extended without changing the size of the transformer winding rack. In addition, in order to make the surface of the two insulation half shells 21 and 22 smoother after assembly, the first insulation portion 212 has a first indented section 215 covered by the second covering section 224 and forming a step difference with the surface of the first insulation portion 212, and the second insulation portion 222 has a second indented section 225 covered by the first covering section 214 and forming another step difference with the surface of the second insulation portion 222. In the embodiment previously discussed, the winding portion 12 of the primary winding rack 1 encased by the first and second insulation half shells 21 and 22 is taken as an example, in practice, the two winding portions 11 and 12 can be encased at the same time by the first and second insulation half shells 21 and 22 according to requirements, as shown in FIG. 5.

Figure 6:
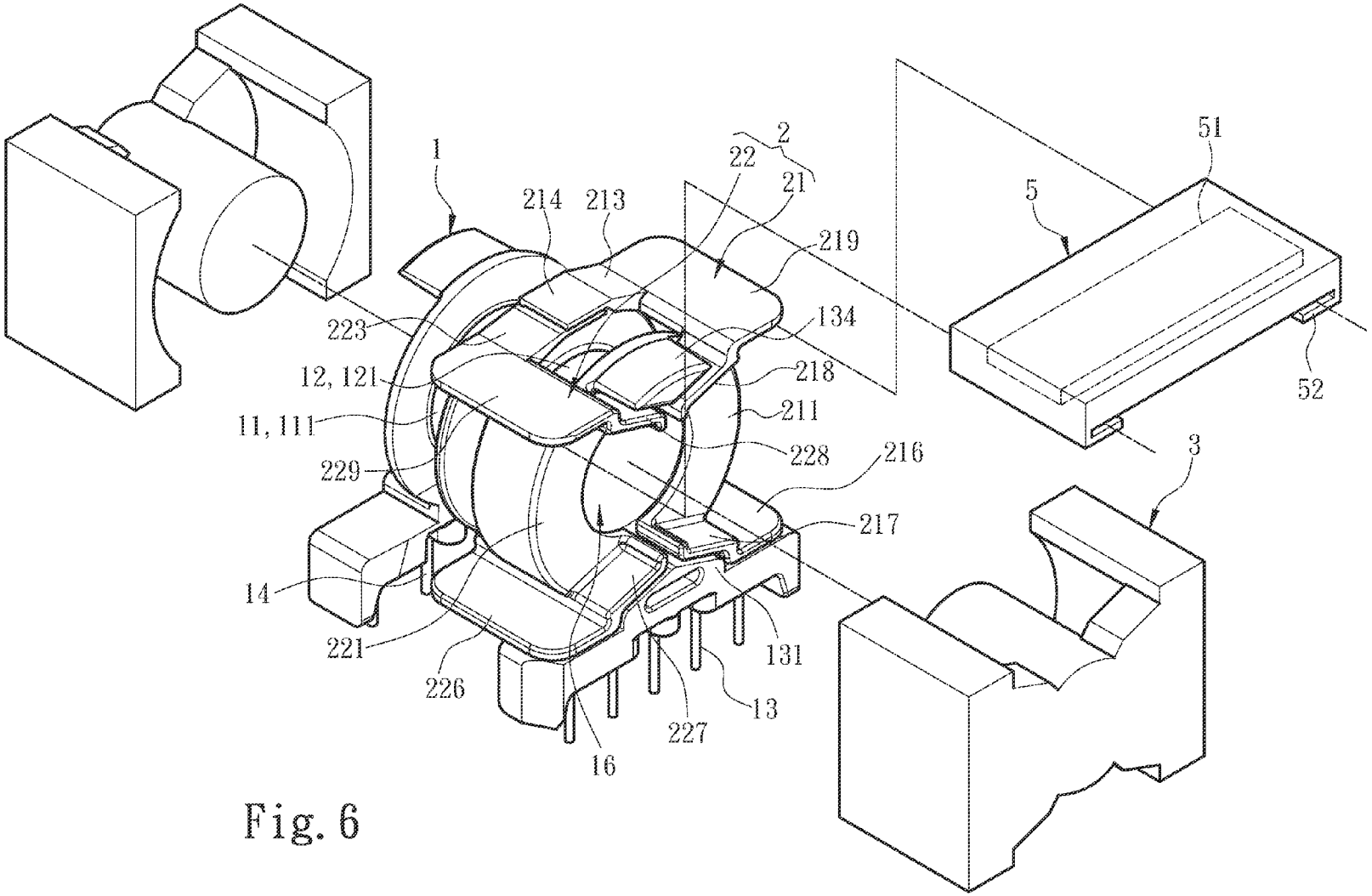
FIG. 6 is an exploded view of a third embodiment of the composite transformer according to the invention.

Also referring to FIG. 6, more specifically, the two wiring portions 13 and 14 are corresponding to each other in structure. Only the wiring portion 13 at one side is discussed herein as an example. The wiring portion 13 further includes a first retaining portion 131 at the opening of one end of the installation channel 16 and two coupling portions 132 and 133 at two sides of the first retaining portion 131. The first and second insulation half shells 21 and 22 have respectively a first abutting portion 216 and a second abutting portion 226 to couple with the coupling portions 132 and 133, and a first positioning portion 217 and a second positioning portion 227 connected to the first and second abutting portions 216 and 226 to butt the first retaining portion 131. In addition, the primary winding rack 1 further has a second retaining portion 134 corresponding to and located above the first retaining portion 131, and the first and second insulation half shells 21 and 22 also have respectively a first auxiliary positioning portion 218 and a second auxiliary positioning portion 228 that are corresponding to each other and butt the second retaining portion 134. To provide improved insulation efficacy and increase creepage distance of the transformer, the invention also provides an auxiliary insulation portion 4 corresponding to the first and second isolating portions 213 and 223 that can be an insulation adhesive tape. In addition, the invention also can provide a leakage inductance adjustment member 5 on the insulation support rack 2. The leakage inductance adjustment member 5 has a magnetic element 51 embedded therein to influence the magnetic paths of the primary winding 111 and secondary winding 121, thereby change the leakage inductance between the primary winding 111 and secondary winding 121. To meet this end, the first insulation half shell 21 has a first installation portion 219 extended from the first auxiliary positioning portion 218 to locate above the first abutting portion 216, and the second insulation half shell 22 has a second installation portion 229 extended from the second auxiliary positioning portion 228 to locate above the second abutting portion 226, and the leakage inductance adjustment member 5 has two tracks 52 to couple respectively with the first and second installation portions 219 and 229.

As a conclusion, the composite transformer with a longer creepage distance according to the invention includes a primary winding rack and an insulation support rack mounted onto the primary winding rack. The insulation support rack includes a first insulation half shell and a second insulation half shell that have respectively a first encasing portion and a second encasing portion to encase the primary winding rack. The first and second encasing portions have respectively a first insulation portion and a second insulation portion, and a first isolating portion and a second isolating portion extended respectively from the first and second insulation portions. The first isolating portion has a first covering section extended towards the second isolating portion to cover the second isolating portion. The second isolating portion has a second covering section extended towards the first isolating portion to cover the first isolating portion. Thereby the creepage distance of the composite transformer can be increased without changing the structural size thereof.

What is claimed is:

1. A composite transformer with a longer creepage distance, comprising:

a primary winding rack including two coaxial winding portions to hold respectively a primary winding and a secondary winding, two wiring portions at two opposite sides of the two winding portions, a separated portion with two spacers spaced from each other to form a spaced section and separate the two winding portions, and an installation channel to hold an iron core set which runs through the two winding portions and forms magnetic coupling with magnetic paths generated by the primary winding and the secondary winding upon being energized by electricity, wherein the winding portions directly connect to the spacers, respectively; and an insulation support rack which is installed on the primary winding rack and includes a first insulation half shell and a second insulation half shell that are corresponding to each other and coupled to encase at least one of the two winding portions, the first insulation half shell and the second insulation half shell including respectively a first encasing portion and a second encasing portion to encase two sides of the at least one of the two winding portions, the first encasing portion and the second encasing portion including respectively a first insulation portion and a second insulation portion corresponding to the separated portion and extending into the spaced section, and a first isolating portion and a second isolating portion extended from the first insulation portion and the second insulation portion respectively to cover another two sides of the at least one of the two winding portions, the first isolating portion including a first covering section extended towards the second isolating portion to cover the second isolating portion, the second isolating portion including a second covering section extended towards the first isolating portion to cover the first isolating portion, wherein the first covering section and the second covering section are overlapped and cover the spaced section and one of the spacers.

2. The composite transformer of claim 1, wherein the first insulation portion includes a first indented section covered by the second covering section and forming a step difference with the surface of the first insulation portion, and the second insulation portion includes a second indented section covered by the first covering section and forming another step difference with the surface of the second insulation portion.

3. The composite transformer of claim 1, wherein each of the two wiring portions includes a first retaining portion located at an opening of one end of the installation channel and two coupling portions at two sides of the first retaining portion, the first insulation half shell and the second insulation half shell including respectively a first abutting portion and a second abutting portion held on the two coupling portions, and a first positioning portion and a second positioning portion connected to the first and second abutting portions to butt the first retaining portion.

4. The composite transformer of claim 3, wherein the primary winding rack includes a second retaining portion located above the first retaining portion and corresponding thereto, the first insulation half shell and the second insulation half shell including respectively a first auxiliary positioning portion and a second auxiliary positioning portion that are corresponding to each other and butt the second retaining portion.

5. The composite transformer of claim 4 further including a leakage inductance adjustment member mounted on the insulation support rack and a magnetic element embedded in the leakage inductance adjustment member, the first insulation half shell including a first installation portion extended from the first auxiliary positioning portion to locate above the first abutting portion, the second insulation half shell including a second installation portion extended from the second auxiliary positioning portion to locate above the second abutting portion, the leakage inductance adjustment member including two tracks to couple respectively with the first installation portion and the second installation portion.

6. The composite transformer of claim 1, wherein the iron core set is selected from the group consisting of EE, EI, FI, FF, TU, UU and UI types.

7. The composite transformer of claim 1 further including an auxiliary insulation portion corresponding to the first isolating portion and the second isolating portion.

8. The composite transformer of claim 1, wherein the two spacers are extended to different heights.

9. The composite transformer of claim 1, wherein the first insulation half shell and the second insulation half shell are mating each other.

* * * * *